US005188517A

United States Patent [19]

Koster

[11] Patent Number: 5,188,517

[45] Date of Patent: Feb. 23, 1993

[54] PUMPING SYSTEM

[76] Inventor: Charles H. Koster, 2015 Clarinda Ave., Wichita Falls, Tex. 76308-1310

[21] Appl. No.: 831,684

[22] Filed: Feb. 5, 1992

[51] Int. Cl.[5] ..... F04B 35/00; F04B 35/02

[52] U.S. Cl. ..... 417/393; 417/383

[58] Field of Search ..... 417/383, 385, 386, 387, 417/388, 393

[56] References Cited

U.S. PATENT DOCUMENTS 2,162,748 6/1939 Richards et al. ..... 417/383
4,540,348 9/1985 Soderberg ..... 417/383
4,551,075 11/1985 Canalizo ..... 417/383
5,069,602 12/1991 Gipston ..... 417/383

*Primary Examiner*—John J. Vrablik
*Assistant Examiner*—Alfred Basichas
*Attorney, Agent, or Firm*—Ewan C. MacQueen

[57] ABSTRACT

A hydraulically activated double-acting piston pump comprising a pump body with an inlet and outlet for the production fluid, and an inlet and outlet for the hydraulic fluid. Thereby eliminating the need for sucker rod strings in pumped wells. A partition located between two coaxial hollow cylinders for keeping the production fluid separate from the hydraulic fluid.

8 Claims, 1 Drawing Sheet (A-A)

(B-B)

(FIG. 1 ROTATED 90°)

PUMPING SYSTEM

The present invention is directed to improved apparatus and method for extracting production fluid from a pumped well and, more particularly, to improved apparatus and method which eliminates the corrosion and wear which inevitably have resulted from the use of sucker rod strings in pumped wells. Other benefits and advantages of the invention will become apparent from the following description.

THE PROBLEM

Pumped wells are a feature of the landscape in oil producing countries because of the distinctive up and down reciprocating motion of the pump jack which drives the sucker rod activating the downhole reciprocating pump. The system presently employed has always been accompanied by high maintenance costs and substantial power consumption. No well of any depth is completely straight with the result that the sucker rod string rubs against and abrades the inner surface of the production tubing at various points. This wear and abrasion can be sufficiently severe to result in holing of the tubing. Furthermore, the sucker rod string is jointed, using threaded joints and couplings. Since the production fluid is corrosive because of the present of agents such as $H_2S$, $CO_2$, salt, water, etc., stress corrosion is a factor which limits the life of the sucker rod string. It has been reported that abrasion and corrosion of sucker rods reduces the cross-section of the string to the point that the string will break of its own weight.

The whole structure of the sucker rod string and its companion production tubing string creates an enormously complex mechanical system, analogous in its operation to a giant tensile fatigue machine. Continuous reversal of loads occurs between the sucker rod string and the production tubing string, resulting in high wear of the threaded joints in the tubing and sucker rod string. Stress factors tend to be magnified in certain areas of the system resulting in accelerated fatigue, stress corrosion and other destructive factors. An additional factor is the action of the downhole pump plunger. Since the system acts as a large spring, when the pump barrel is full of liquid as the plunger starts its downstroke the system is fluid damped. If the system is "pump down" (the supply of fluid to the pump is less than the pump's production capacity) the system is no longer fluid damped, greatly increasing mechanical stress.

The art has been moving in the direction of employing "coil tubing" as the production tubing in place of tubing made of shorter lengths joined together in a string by means of threaded joints. However, this desirable move is inhibited by the holing of the coil tubing by abrasion from the sucker rod string.

When any of the aforementioned untoward events occur, the sucker rod string and possibly also the production tubing string must be pulled from the well for repair or replacement. This is an expensive operation itself and is accompanied by loss of production from the well. Kenneth W. Gray in *Petroleum Engineer International*, May 1991 pages 27 to 31, reports that the average rod recovery rate in 1990 was only 27% in three Texas fields. Gray also reports that about 50% of all withdrawn rod pump well tubing sent in for inspection was rejected with about half of the rejects being due to rod-on-tubing wear or abrasion. Gray reported on the benefits occurring from various metal and plastic coatings on sucker rods and couplings and tubing I.D. While substantial increases in service life of the coated components is reported, coating itself is an expensive procedure and difficult to perform on coil tubing I.D., since coil tubing can be 1000 or more feet long.

A further drawback of the sucker rod system is the surface pumpjack, a high wear mechanical system with large shifting loads causing wear and inefficient power demands.

While, as noted, incremental benefits can be obtained in the existing system, its basic design creates so many problems that the only way to make a substantial improvement is to eliminate the sucker rod string altogether. It is the primary objective of the present invention to accomplish elimination of the sucker rod string from a pump well pumping system.

BRIEF STATEMENT OF THE INVENTION

Briefly stated, the invention contemplates extracting production fluid from a well comprising a downhole hydraulically driven pump communicating with production fluid in the well and with a conduit for delivering production fluid from the pump to the surface and a hydraulic pump on the surface fluidly connected to the downhole pump. Desirably, the downhole pump is located in sealed relation to the bottom end of the tubing string which acts to deliver the pumped production fluid to the surface. It is convenient for both the downhole pump and the surface pump to be double acting reciprocating pumps connected to each other in a closed loop. In this system, the only downhole moving parts likely to encounter wear are the pump piston and necessary check valves. It is also an advantage to enclose the hydraulic conduits within a coiled tubing string and to suspend the downhole pump unit on the end of the coiled tubing. In this way, the pump unit may be removed for service by pulling the coiled tubing string holding the pump, leaving the tubing string in place. This eliminates the requirement of the normal workover rig and crew to run tubing and/or sucker rod on every maintenance job.

DETAILED DESCRIPTION OF THE INVENTION

Figure 3:
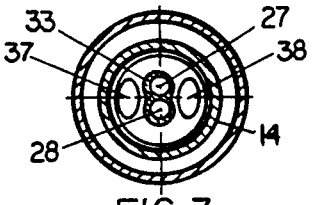
FIG. 3 is a sectional view taken on the line A—A of FIG. 1.
Figure 4:
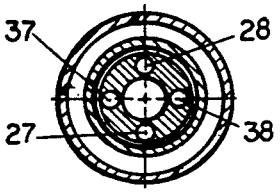
FIG. 4 is a sectional view taken on the line B—B of FIG. 1.

The invention will now be described in conjunction with the drawing, the embodiment representing the best mode presently known.

Figure 1:
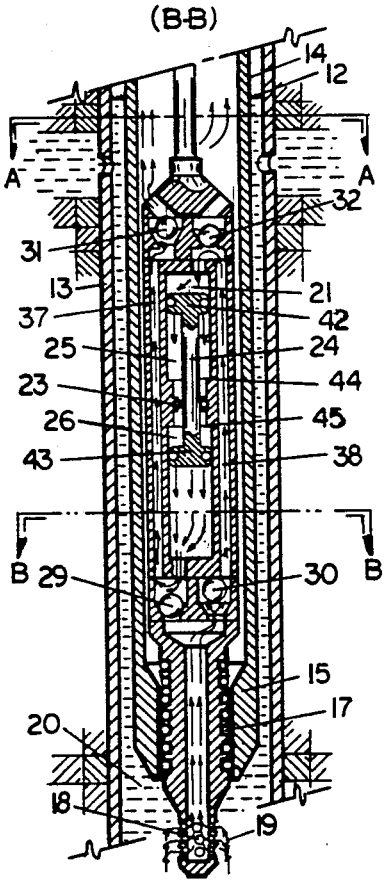
FIG. 1 illustrates a cross-section view of the present invention.
Figure 2:
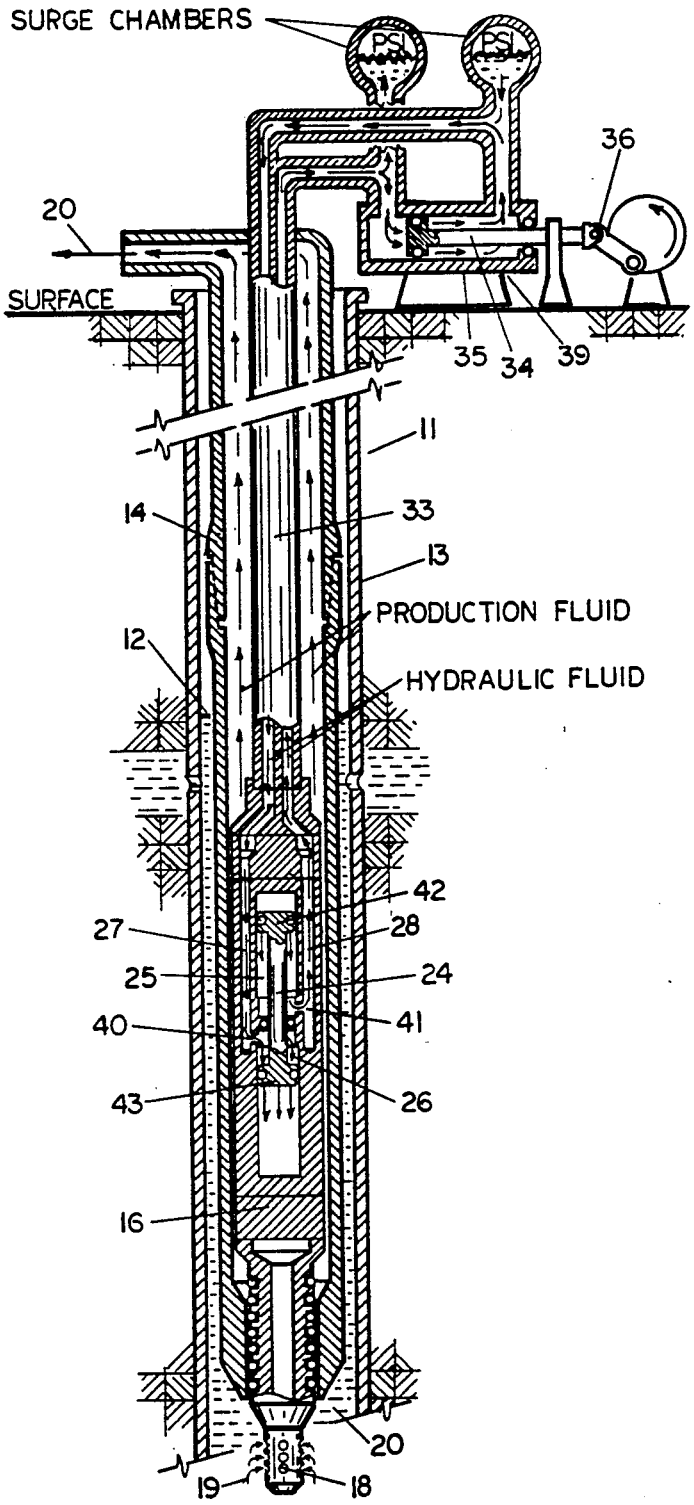
FIG. 2 illustrates the drawing of FIG. 1 rotated 90°.

Referring to FIGS. 1 and 2, reference Character 11 represents generally a well having a fluid level indicated at 12. The well comprises casing 13 and tubing 14. Tubing 14 is fitted at the end with Socket 15 into which downhole pump 16 is seated to form a seal 17, between pump 16 and tubing I.D. Pump 16 is fitted at the lower end with production fluid inlet 18 which may be provided with appropriate screens as indicated by the multiple holes 19. Inlet 18 admits production fluid 20 to the interior of pump 16. Pump 16 and surface pump 39 comprise a closed-loop double acting hydraulic system joined by hydraulic passages 27 and 28. Pump 16 has chambers 21 and 22 separated by partition 23 and fitted with double-acting piston 42, 43 connected by piston rod 24. Piston 42, 43 powered by hydraulic fluid alternately supplied to Chambers 25 and 26 through hydraulic passages 27 and 28. Passage of production fluid 20 through pump 16 is controlled by intake check valves 29 and 30 and outlet check valves 31 and 32. Thus, as pistons 42, 43 move downward under the impetus of hydraulic fluid admitted through port 40 as illustrated in FIGS. 1 and 2 valve 29 closes and valve 31 opens to permit production fluid in Chamber 22 to be expelled from pump 16 through passage 37. Simultaneously, valve 30 opens and valve 32 closes to admit production fluid 20 into chamber 21. When piston 42, 43 reach the bottom of their downward stroke hydraulic fluid is supplied to chamber 25 through port 41 to move piston 42, 43 upward. When this occurs, valves 30 and 31 close while valves 29 and 32 open, expelling production fluid from chamber 21 through valve 32. When valve 30 is open, production fluid moves through passage 38. As shown in FIGS. 1 and 2, partition 23 is provided with stops 44, 45 to permit fluid flow through ports 40, 41 when piston direction is to be changed.

Preferably pump 16 is suspended from coil tubing 33 containing hydraulic passages 27 and 28 connected to the surface mounted pump 39 containing power ram 34 reciprocating within power cylinder 35. Ram 34 is impelled by power input 36.

As the power ram 34 is stroked forward and backward, the flow through each outlet of the cylinder 35 is alternately reversed, and the piston 42, 43 in downhole pump 16 are also alternately reversed by means of hydraulic fluid supplied from surface pump 39 through hydraulic passages on conductors 27 and 28.

In the system depicted all conductors are full of fluid and have the same head so that net pressure differences, and thereby loads are very small. The load variation is much less than in conventional mechanical pumping units in which dramatic load reversals occur as discussed previously. In the present system moving parts are reduced to the pump piston and check valves while wear is essentially limited to the pump barrel and piston. The potential for holing the production tubing is eliminated since there is no sucker rod moving in a reciprocating manner in contact with portions of the tubing. In the present system, production fluid being pumped need only be raised in pressure sufficiently to exceed the pressure head at the pump. The net pressure difference required is small. In conventional mechanical systems, on the other hand, the pump has to lift the entire column of fluid, e.g., oil, water, in order for movement of production fluid to occur. Differential stresses are high and weight transfers occur on each stroke between the sucker rod string and the tubing string, with wear on threaded joints being severe.

It will be appreciated that variations of the aforedescribed system may be employed without departing from the spirit and scope of the appended claims. For instance a low cost system may be single acting hydraulic system with the return stroke provided by a dead weight or a spring or a compressible gas. In some cases the casing may be used as a conduit. Also, the pressure pulse required to lift the pump plunger could be a gas pressure pulse.

Production fluid may be used as hydraulic fluid in many cases and replacement of leaked hydraulic fluid may be made automatically. Rotary pumps may be used both at the surface and downhole particularly when production fluid is used as the hydraulic fluid.

It is also to be appreciated that the pump shown herein is capable of other uses such as in handling corrosive fluids, exposure to explosive or other hazards, such as radiation. Thus, the power unit is at a location remote from the pump and is not subjected to the conditions existing at the pump.

The hydraulic lines can be provided with surge tanks and dampers to prevent excessive stresses as either pump is operated at or near the end of its stroke. Piston rings and various seals required, e.g., where the connecting rod passes through the partition, the seal of the pump to the socket, etc. can be o-rings. Various construction materials, e.g., steel, glass, plastic, corrosion-resistant alloy, etc., can be used to construct the pump.

I claim:

1. Means for extracting production fluid from a well having casing means and tubing means disposed therein comprising;

1) a downhole hydraulically driven pump communicating with said production fluid
2) first conduit means for delivering said production fluid from said pump to the surface
3) hydraulic pump means on the surface connected by
4) second conduit means therefrom to said downhole hydraulic pump means whereby hydraulic fluid from said surface pump means delivered to said downhole pump means activates said downhole pump means and pumps said production fluid to the surface, said tubing means comprising said first conduit means, each of said surface pump means and said downhole pump means being a double acting cylinder connected in closed circuit by said second conduit means.

2. Means in accordance with claim 1 wherein said tubing means comprises coil tubing.

3. Means in accordance with claim 2 wherein said downhole pump is engaged in sealed relation with said tubing.

4. Means in accordance with claim 1 wherein said second conduit means comprises coil tubing.

5. Means in accordance with claim 1 wherein said downhole pump is fitted with both intake and outlet valve means whereby production fluid is admitted to said cylinder and is impelled toward the surface on each stroke of said pump.

6. The method for extracting production fluid from a well which comprises providing downhole hydraulic double-acting, reciprocating, piston pump means communicating with said production fluid and communicating with the surface through production fluid conduit means, and driving said downhole pump means with hydraulic fluid communicating therewith from a source of pressurized hydraulic fluid on the surface to pump production fluid with each stroke of said pump.

7. A hydraulically activated double-acting piston pump comprising 1) a pump body having an inlet end and an outlet end for production fluid being forced therethrough
2) at least two coaxial hollow cylinders within said pump body
3) pistons in each of said cylinders connected by a piston rod extending through a seal into each of said cylinders
4) hydraulic fluid conducting means connected to each of said cylinders to drive said pistons in a reciprocating manner 5) production fluid conducting means connected to said cylinders to admit production fluid to said cylinders when said pistons move in one direction and to expel production fluid from said cylinders when said pistons move in the opposite direction 6) check valve means in said production fluid conducting means to control the flow of production fluid from said inlet end to said outlet end.

8. A pump in accordance with claim 7 wherein said hydraulic fluid conducting means connect within each of said cylinders at points adjacent to and on opposite sides of said seal.

* * * * *